US009802212B2

(12) United States Patent
Kitamura et al.

(10) Patent No.: US 9,802,212 B2
(45) Date of Patent: Oct. 31, 2017

(54) PLASMA SPRAYING APPARATUS

(71) Applicants: THE CHUGOKU ELECTRIC POWER CO., INC., Hiroshima (JP); Yamaguchi University, Yamaguchi-shi, Yamaguchi (JP)

(72) Inventors: Tomoaki Kitamura, Hiroshima (JP); Makoto Tanaka, Hiroshima (JP); Hideo Ishimaru, Hiroshima (JP); Satoshi Sakiyama, Yamaguchi (JP)

(73) Assignees: THE CHUGOKU ELECTRIC POWER CO., INC., Hiroshima (JP); Yamaguchi University, Yamaguchi-shi, Yamaguchi (JP)

( * ) Notice: Subject to any disclaimer, the term of this patent is extended or adjusted under 35 U.S.C. 154(b) by 0 days.

(21) Appl. No.: 14/780,225

(22) PCT Filed: Mar. 27, 2014

(86) PCT No.: PCT/JP2014/058794
§ 371 (c)(1),
(2) Date: Nov. 25, 2015

(87) PCT Pub. No.: WO2014/157491
PCT Pub. Date: Oct. 2, 2014

(65) Prior Publication Data

US 2016/0074887 A1 Mar. 17, 2016

(30) Foreign Application Priority Data

Mar. 28, 2013 (JP) ..... 2013-069945

(51) Int. Cl.
*B05C 5/04* (2006.01)
*B05B 7/22* (2006.01)
(Continued)

(52) U.S. Cl.
CPC ..... *B05B 7/222* (2013.01); *B05B 1/34* (2013.01); *B05B 7/224* (2013.01); *C23C 4/134* (2016.01);
(Continued)

(58) Field of Classification Search
CPC .. B05B 7/22; B05B 7/224; B05B 1/34; C23C 4/134; H05H 1/34; H05H 1/42; H05H 1/44
(Continued)

(56) References Cited

U.S. PATENT DOCUMENTS 4,670,290 A 6/1987 Itoh et al.
5,243,169 A * 9/1993 Tateno ..... B05B 7/226 219/121.48
(Continued)

FOREIGN PATENT DOCUMENTS

EP 0427194 A2 5/1991
GB 1384730 A 2/1975
(Continued)

OTHER PUBLICATIONS

Office Action issued in corresponding Japanese Application No. 2015-508681 dated May 31, 2016, and English translation thereof (5 pages).
(Continued)

*Primary Examiner* — Jason Boeckmann
(74) *Attorney, Agent, or Firm* — Osha Liang LLP

(57) ABSTRACT

A plasma spraying apparatus includes a main torch and an auxiliary torch. The main torch includes a first electrode including a spraying material discharge hole, a first mantle, and a first insulator including a first plasma gas introducing port. The auxiliary torch includes a second electrode, a second mantle, and a second insulator including a second plasma gas introducing port. A spraying material supplied
(Continued)

from the spraying material discharge hole is melted at the axial center of plasma that is formed on the central axis of the first electrode by the first electrode and the second electrode, and a gas introducing part that introduces gas is provided on an inlet side of an opening part and/or in a tapered part provided between the opening part and the first insulator in the first mantle.

20 Claims, 6 Drawing Sheets

(51) Int. Cl.

| | |
|---|---|
| ***H05H 1/42*** | (2006.01) |
| ***H05H 1/44*** | (2006.01) |
| ***C23C 4/134*** | (2016.01) |
| ***B05B 1/34*** | (2006.01) |
| ***H05H 1/34*** | (2006.01) |

(52) U.S. Cl.
CPC ..... *H05H 1/34* (2013.01); *H05H 1/42* (2013.01); *H05H 1/44* (2013.01); *H05H 2001/3436* (2013.01); *H05H 2001/3478* (2013.01)

(58) Field of Classification Search
USPC ..... 239/463, 79
See application file for complete search history.

(56) References Cited

U.S. PATENT DOCUMENTS

| | | | |
|---|---|---|---|
| 2010/0314466 | A1 | 12/2010 | Wigren et al. |
| 2010/0314467 | A1 | 12/2010 | Wigren et al. |

FOREIGN PATENT DOCUMENTS

| | | | | |
|---|---|---|---|---|
| JP | S51-13473 | B2 | | 4/1976 |
| JP | S61-259778 | A | | 11/1986 |
| JP | S62-130777 | A | | 6/1987 |
| JP | S63-91160 | A | | 4/1988 |
| JP | H02-79400 | A | | 3/1990 |
| JP | 2002231498 | A | * | 8/2002 |
| JP | 2004-082024 | A | | 3/2004 |
| JP | 3733461 | B2 | | 1/2006 |
| JP | 2009-195883 | A | | 9/2009 |
| JP | 2010-110669 | A | | 5/2010 |
| JP | 4804854 | B2 | | 11/2011 |

OTHER PUBLICATIONS

Office Action in corresponding Japanese Patent Application No. 2015-508681 mailed Mar. 22, 2016 (2 pages).
International Preliminary Report on Patentability from PCT/JP2014/058794 issued on Oct. 8, 2015 (8 pages).
Partial English Translation of Japanese Application H2-79400 published on Mar. 19, 1990 (3 pages).
Office Action issued in corresponding Japanese Application No. 2015-508681 dated Dec. 8, 2015 (2 pages).
English translation of Written Opinon issued in corresponding International Application No. PCT/JP2014/058794 dated Jun. 10, 2014 (7 pages).
International Search Report issued in PCT/JP2014/058794 mailed on Jun. 10, 2014 (2 pages).
Written Opinion of the International Searching Authority issued in PCT/JP2014/058794 mailed on Jun. 10, 2014 (4 pages).
Extended European Search Report issued in corresponding European Application No. 14772681.4 dated Nov. 7, 2016 (10 pages).
Office Action issued in corresponding Chinese Application No. 201480018567.X dated Sep. 19, 2016, and English translation thereof (15 pages).
Office Action issued in corresponding Japanese Application No. 2015-508681 Dated Aug. 30, 2016, and English translation thereof (5 pages).
Office Action in counterpart Chinese Patent Application No. 201480018567.X dated Jun. 13, 2017 (14 pages).
Office Action in counterpart Korean Patent Application No. 10-2015-7030954 dated Jun. 19, 2017 (10 pages).

* cited by examiner

PLASMA SPRAYING APPARATUS

TECHNICAL FIELD

One or more embodiments of the present invention relate to a plasma spraying apparatus that can supply a spraying material to an axial center of plasma to be formed on a center axis of an electrode of a main torch by electrodes of the main torch and an auxiliary torch, and that can suppress adhesion of a spraying material on the inner wall of an opening part in a mantle of the main torch.

BACKGROUND ART

Conventionally, in a plasma spraying apparatus that comprises a main torch and an auxiliary torch having an electrode, a mantle that surrounds the electrode, and an insulator that insulates the electrode and the mantle from each other and includes a plasma gas introducing port, a plasma spraying apparatus has been developed in which a material discharge hole is provided at a tip center of the central axis of the electrode of the main torch, the spraying material is supplied to the center of the plasma axis from the material discharge hole, the spraying material is efficiently melted, and a dense film of the spraying material having little pores can be efficiently formed without being welded to the main torch (for example, see Japanese Patent No. 3733461 Specification, Japanese Patent No. 4804854 Specification, Japanese Patent Application Laid-open Publication No. 2010-110669 and the like).

SUMMARY OF INVENTION

However, even in the plasma spraying apparatus as stated above, it has been found that the spraying material adheres to the inner wall of the opening part in the mantle of the main torch, and this may cause a blockage of the opening part.

One or more embodiments of the present invention provide a plasma spraying apparatus that can supply the spraying material to the axial center of the plasma to be formed on the central axis of the electrode of the main torch by the electrodes of the main torch and the auxiliary torch and that can suppress the adhesion of the spraying material on the inner wall of the opening part in the mantle of the main torch.

It has been found that a gas introducing part is provided to an inlet of the opening part in the mantle of the main torch or in the tapered part between the opening part and the insulator to introduce gas, thereby preventing the spraying material from adhering to the inner wall of the opening part in the mantle of the main torch, and this leads to accomplish one or more embodiments of the present invention.

That is, one or more embodiments of the present invention may be realized as:

(1) a plasma spraying apparatus, including:

a main torch including a first electrode having a spraying material discharge hole at a tip center of a central axis, a first mantle that surrounds the first electrode, and a first insulator that insulates the first electrode and the first mantle from each other and has a first plasma gas introducing port; and an auxiliary torch including a second electrode, a second mantle that surrounds the second electrode, and a second insulator that insulates the second electrode and the second mantle from each other and has a second plasma gas introducing port, the auxiliary torch having a central axis that intersects with a central axis of the main torch, a spraying material supplied from the spraying material discharge hole to an axial center of plasma to be formed on the central axis of the first electrode by the first electrode and the second electrode being melted, the melted spraying material being sprayed on a base material to form a coating of the spraying material, the first mantle including an opening part and a tapered part provided between the opening part and the first insulator, and the first mantle including, on an inlet side of the opening part and/or the tapered part, a gas introducing part that introduces gas;

(2) the plasma spraying apparatus according to the above-stated (1), wherein the first electrode is an anode, and the second electrode is a cathode;

(3) the plasma spraying apparatus according to the above-state (2), wherein the opening part includes a third insulator at the center, and the auxiliary torch is provided closer to an outlet side than the third insulator of the opening part;

(4) the plasma spraying apparatus according to the above-stated (2), wherein the main torch and the auxiliary torch are arranged so that a plasma arc is formed in the outside;

(5) the plasma spraying apparatus according to the above-stated 4, further comprising a plurality of auxiliary torches, wherein the plurality of auxiliary torches are arranged so that central axes of the plurality of auxiliary torches are respectively intersected at one point of the central axis of the main torch outside the main torch;

(6) the plasma spraying apparatus according to any one of the above-stated (3) to (5), wherein an anode spot of the first electrode and the spraying material discharge hole are configured not to interfere with one another (7) the plasma spraying apparatus according to any one of the above-stated (3) to (5), wherein a tip surface of the first electrode is formed in an inwardly protruding shape;

(8) the plasma spraying apparatus according to any one of the above-stated (3) to (7), wherein a tip of the first electrode is provided with a gas ejection hole for preventing adhesion of the spraying material;

(9) the plasma spraying apparatus according to any one of the above-stated (3) to (8), wherein the gas introducing part of the first mantle includes, on an inlet side of the opening part and/or the tapered part, a gas ejection hole that introduces gas;

(10) the plasma spraying apparatus according to any one of the above-stated (3) to (8), wherein the gas introducing part of the first mantle includes a gas ejection hole through which gas is ejected to have a circumferential velocity component with respect to the central axis so that the gas is allowed to be a swirl flow inside the opening part and the tapered part;

(11) the plasma spraying apparatus according to any one of the above-stated (3) to (8), wherein the first mantle is constituted by a porous metal, and the gas introducing part is configured such that gas introduced from the outside is ejected through holes in the porous metal only in an inside direction of the first mantle;

and the like.

Advantageous Effects of Invention

According to one or more embodiments of the present invention, there can be provided a plasma spraying apparatus that can supply the spraying material to the axial center of the plasma to be formed on the central axis of the electrode of the main torch by the electrodes of the main torch and auxiliary torch, and that can suppress the adhesion of the spraying material on the inner wall of the opening part in the mantle of the main torch.

DESCRIPTION OF EMBODIMENTS

One or more embodiments of the plasma spraying apparatus are described in detail below with reference to the accompanying drawings. Note that, features, advantages and ideas of one or more embodiments of the present invention are apparent to those skilled in the art from the description of the present specification and those skilled in the art can easily reproduce the present invention from the description of the present specification. Embodiments of the invention and drawings described below are shown for illustrative or explanatory purposes, and thus one or more embodiments of the present invention are not limited thereto. It is apparent to those skilled in the art that various modifications may be made based on the description of the present specification within the spirit and the scope of one or more embodiments of the present invention disclosed herein.

Figure 1:
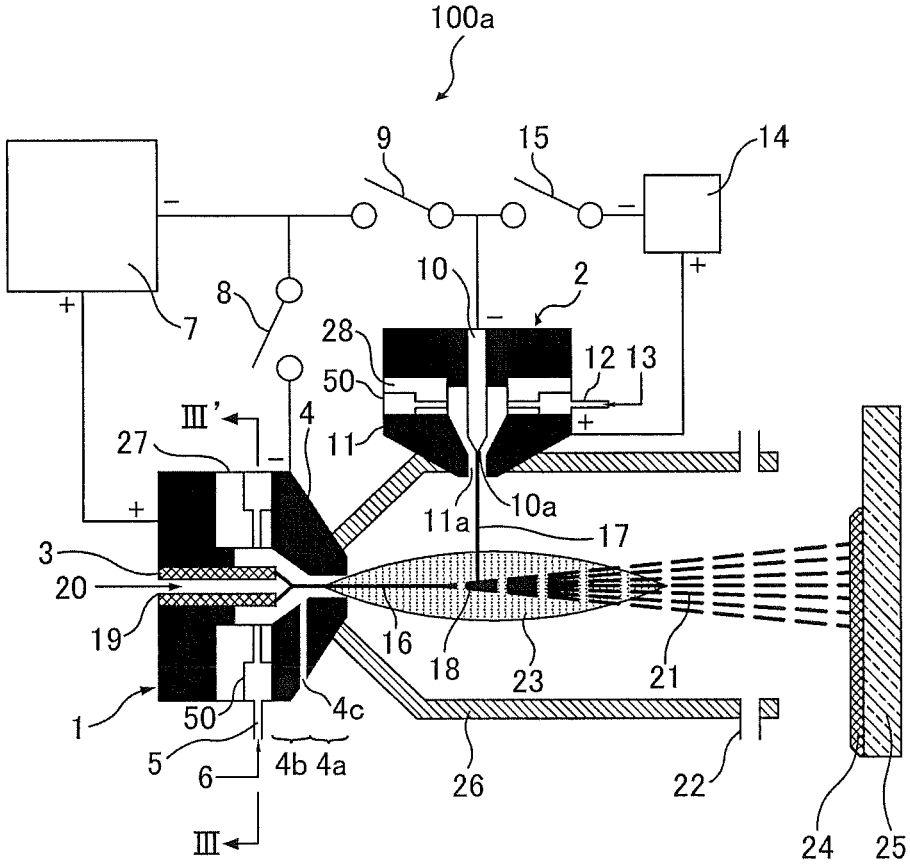
FIG. 1 shows a schematic configuration of a combined torch type plasma spraying apparatus 100*a* according to one or more embodiments of the present invention.

First, a combined torch type plasma spraying apparatus including a main torch and an auxiliary torch is described as a plasma spraying apparatus of one or more embodiments of the present invention. Note that, in the present embodiment, as an example of the combined torch type plasma spraying apparatus including the main torch and the auxiliary torch, a combined torch type plasma spraying apparatus 100*a* is described in which an electrode in the main torch is a main anode and an electrode in the auxiliary torch is an auxiliary electrode (cathode). However, the plasma spraying apparatus including the main torch and the auxiliary torch may be a combined torch type plasma spraying apparatus in which an electrode in the main torch is a main cathode and an electrode in the auxiliary torch is an auxiliary anode. FIG. 1 shows a schematic configuration of the combined torch type plasma spraying apparatus 100*a*, which is illustrated as one or more embodiments of the present invention.

A main torch 1 includes a main anode 3, a main mantle 4 that surrounds the main anode 3, an insulator 27 that insulates the main anode 3 and the main mantle 4 from each other, and the like.

The main anode 3 is formed by a material excellent in electrical conductivity, for example, a metal such as copper. The main anode 3 includes a material feed-in pipe 19 having a spraying material discharge hole at the tip center of the central axis. The main anode 3 is concentrically held with the main mantle 4 by the insulator 27.

The main mantle 4 includes an opening part (nozzle part) 4*a* at the tip part and a tapered part 4*b* provided between the opening part 4*a* and the insulator 27. The tapered part 4*b* is provided with a gas introducing hole 4*c* that introduces an inert gas or the like and forms a swirl gas flow.

Figure 2:
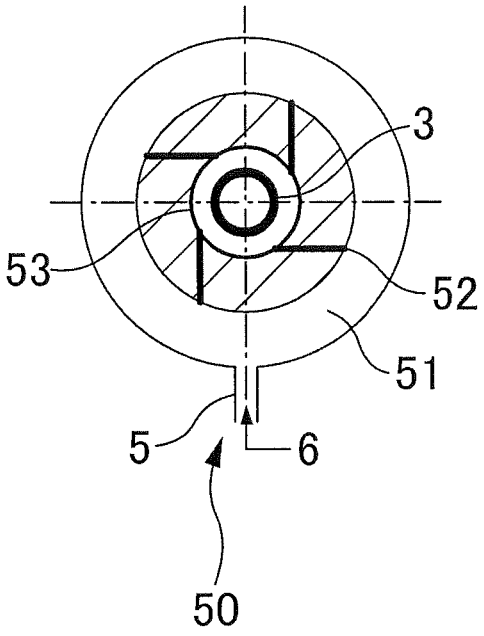
FIG. 2 shows a cross section taken along line III-III' in FIG. 1.

The insulator 27 includes a main plasma gas introducing port 5 that introduces a main plasma gas 6 and a swirl flow forming means 50 for the introduced main plasma gas 6. As shown in FIG. 2, the main plasma gas 6 is introduced into an annular gas chamber 51, passes through four swirl flow forming holes 52, and flows toward the opening part 4*a* of the main mantle 4 so as to rotate along an inner wall 53 (a space between the inner wall 53 and the main anode 3) of the insulator 27. Note that, one swirl flow forming hole 52 mentioned above may be arranged or a plurality of swirl flow forming holes 52 may be arranged, and when the plurality of swirl flow forming holes are arranged, it is preferable that those swirl flow forming holes are uniformly arranged about the central axis.

As shown in FIG. 1, a positive terminal of a main power source 7 is connected to the main anode 3, and a negative terminal of the main power source 7 is connected to the main mantle 4 through a switching means 8.

The auxiliary torch 2 includes an auxiliary cathode (auxiliary torch activating electrode) 10, an auxiliary mantle 11 that surrounds the auxiliary cathode 10, an insulator 28 that insulates the auxiliary cathode 10 and the auxiliary mantle 11 from each other, and the like. The central axis of the auxiliary torch 2, that is, the central axis of the auxiliary cathode 10 is arranged so as to intersect with the central axis of the main torch 1, that is, the central axis of the main anode 3, in front of the main anode 3 and the auxiliary cathode 10.

The auxiliary cathode 10 is formed of a material having a high melting point, for example, such as tungsten. The auxiliary cathode 10 is concentrically held with the auxiliary mantle 11 by the insulator 28.

The auxiliary mantle 11 includes a hole 11*a* at the tip part. The insulator 28 includes an auxiliary plasma gas introducing port 12 that introduces an auxiliary plasma gas 13 and a swirl flow forming means 50 similar to that in the insulator 27 of the main torch 1.

A positive terminal of an auxiliary power source 14 is connected to the auxiliary mantle 11, and a negative terminal of the auxiliary power source 14 is connected to the auxiliary cathode 10 through a switching means 15 and is also connected to the negative terminal of the main power source 7 through a switching means 9.

Next, a method of plasma spraying a spraying material (for example, a conductive material such as metal, an insulating material such as ceramics, and the like, the same applies to the following) by the use of the combined torch type plasma spraying apparatus 100*a* is described.

An inert gas such as argon, helium capable of turning into plasma is introduced into the main torch 1 as the main plasma gas 6 from the main plasma gas introducing port 5, and a swirl flow of the main plasma gas 6 is formed. Further, in a state in which the switching means 9 is opened and the switching means 8 is closed, a high frequency voltage is applied between the main anode 3 and the main mantle 4 from the main power source 7. As a result, a main plasma arc 16 directed from the tip of the main anode 3 to the opening part 4*a* of the main mantle 4 is formed. This allows the main plasma gas 6 to be heated and become plasma, and then this plasma is released from the opening part 4*a* of the main mantle 4.

In addition, the inert gas such as argon, helium capable of turning into plasma is introduced into the auxiliary torch 2 from the auxiliary plasma gas introducing port 12 as the auxiliary plasma gas 13, and the swirl flow of the auxiliary plasma gas 13 is formed. Further, in a state where the switching means 15 is closed, a high frequency voltage is applied between the auxiliary cathode 10 and the auxiliary mantle 11 from the auxiliary power source 14. As a result, an auxiliary plasma arc 17 directed from the tip 10*a* of the auxiliary cathode 10 toward the hole 11*a* of the auxiliary mantle 24 is formed. This allows the auxiliary plasma gas 13 to be heated and become plasma, and then this plasma is released from the hole 11*a* of the auxiliary mantle 11.

Since the central axis of the main anode 3 and the central axis of the auxiliary cathode 10 are intersected with each other outside the main torch 1 and the auxiliary torch 2 in front of the main anode 3 and the auxiliary cathode 10, when the switching means 9 is closed and the switching means 8, 15 are opened, a conductive path using a hairpin-like plasma 18 that reaches an anode spot of the main anode 3 from the tip part 10*a* of the auxiliary cathode 10 is formed.

In this case, by appropriately setting the configuration of the main torch 1 and the amount of the main plasma gas 6 to be supplied, and the configuration of the auxiliary torch 2 and the amount of the auxiliary plasma gas 13 to be supplied to the auxiliary torch 2, a plasma flame 23 can be formed substantially coaxially with the main torch 1 as shown in FIG. 1.

The spraying material 20 discharged through the spraying material discharge hole from the material feed-in pipe 19 is supplied to the axial center of the plasma 18 to be formed on the central axis of the main anode 3 by the main anode 3 and the auxiliary cathode 10, and is melted by the plasma flame 23. In one or more embodiments of the present invention, when the spraying material 20 is discharged from the spraying material discharge hole, an inert gas or the like (for example, an inert gas such as an argon gas, and an active gas such as air or an oxygen gas) is introduced by the gas introducing hole 4*c* provided in the tapered part 4*b* of the main mantle 4 to form the swirl gas flow. In this way, it becomes possible to uniformly and axisymmetrically generate negative pressure gradient toward the central axis from the inner wall of the main mantle 4 in an inner space of the main mantle 4 as compared to the case of directly ejecting an inert gas to the central axis from the inert gas ejection hole. This allows to focus the plasma stably and uniformly in the inner space of the mantle, while preventing the adhesion of the spraying material 20 even to a part away from the inert gas ejection hole such as the inner wall of the opening part 4*a* and the tip part of the tapered part 4*b* in the main mantle 4.

Further, since the adhesion of the spraying material 20 can be prevented, the spraying material 20 can be efficiently melted. Note that, in the present embodiment, the gas introducing hole 4*c* is provided in the tapered part 4*b* of the main mantle 4. However, the gas introducing hole 4*c* may be provided on an inlet side of the opening part 4*a* of the main mantle 4 and may be provided in the tapered part 4*b* of the main mantle 4 and on the inlet side of the opening part 4*a*, respectively.

Figure 5:
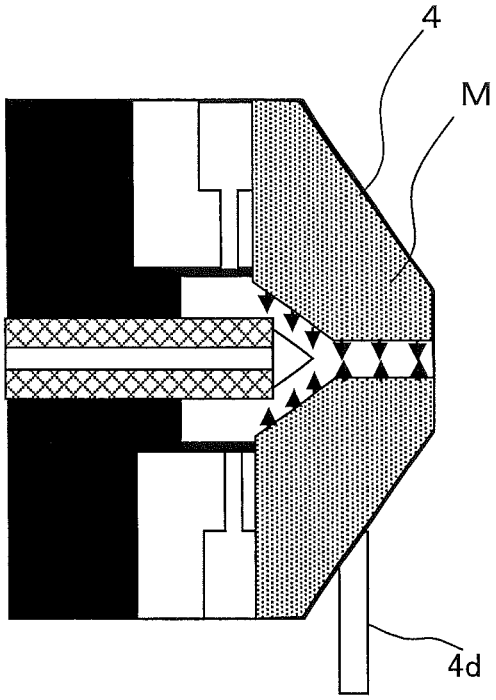
FIG. 5 shows a schematic configuration of the mantle according to one or more embodiments of the present invention.

Further, as shown in FIG. 5, instead of providing the gas ejection hole 4*c* for forming the swirl flow, the main mantle 4 may be constituted by a porous metallic material M so as to form on the whole inner surface of the mantle the gas flow for preventing the adhesion of the spraying material, and the gas supplied from the gas introducing port 4*d* provided in the main mantle 4 may be ejected only in the inside direction of the main mantle 4 through micropores in the porous metallic material M as shown by the arrow in the FIG. 5.

A melt 21 which is the melted spraying material 20 travels toward a base material 25 with the plasma flame 23. Only plasma 18 is separated immediately in front of the base material 25 by a plasma separation means 22 provided on a connecting pipe 26, and the melt 21 is sprayed on the base material 25. Thus, a coating 24 of a dense spraying material 20 having little pores can be efficiently formed.

Next, a plasma spraying apparatus including a main torch and two auxiliary torches is described as a plasma spraying apparatus of one or more embodiments of the present invention. Note that, in the present embodiment, as an example of the plasma spraying apparatus including a main torch and two auxiliary torches, a twin-cathode type plasma spraying apparatus 100*b* is described in which the electrode in the main torch is a main anode, and the electrodes in the auxiliary torches are auxiliary cathodes. However, the plasma spraying apparatus including a main torch and two auxiliary torches may be a twin-anode type plasma spraying apparatus in which the electrode in the main torch is a main cathode and the electrodes in the auxiliary torches are auxiliary anodes. FIG. 2 shows a schematic configuration of the twin-cathode type plasma spraying apparatus 100*b*, which is illustrated as one or more embodiments of the present invention.

Since the configuration of the main torch 1 and the auxiliary torch 2 included in the twin-cathode type plasma spraying apparatus 100*b* is identical to that of the main torch 1 and the auxiliary torch 2 in the combined torch type plasma spraying apparatus 100*a*, the description thereof will be omitted herein.

Note that, the positive terminal of the main power source 7 is connected the auxiliary mantle 11 through the main anode 3 and a switching means 55, and the negative terminal of the main power source 7 is connected to the main mantle 4 through the switching means 8. Further, the positive terminal of the auxiliary torch 2 from an auxiliary power source 42 is connected to the auxiliary mantle 11 through a switching means 45, and the negative terminal of the auxiliary torch 2 from the auxiliary power source 42 is connected to the auxiliary cathode 10 through a switching means 46 and is also connected to the negative terminal of the main power source 7 through the switching means 9.

In the present embodiment, another auxiliary torch 39 is arranged at a position opposing to the auxiliary torch 2 with respect to the central axis of the main torch. The auxiliary torch 39 includes an auxiliary cathode (auxiliary torch activating electrode) 40, an auxiliary mantle 41 that surrounds the auxiliary cathode 40, an insulator 47 that insulates the auxiliary cathode 40 and the auxiliary mantle 41 from each other, and the like. The central axis of the auxiliary torch 39, that is, the central axis of the auxiliary cathode 40 is arranged so as to intersect with the central axis of the main torch 1, that is, the central axis of the main anode 3 in front of the main anode 3 and the auxiliary cathode 40.

The auxiliary cathode 40 is formed of a material having a high melting point, for example, such as tungsten. The auxiliary cathode 40 is concentrically held with the auxiliary mantle 41 by the insulator 48.

The auxiliary mantle 41 includes a hole 41*a* at the tip part. The insulator 47 includes an auxiliary plasma gas introducing port 48 that introduces an auxiliary plasma gas 49 and a swirl flow forming means 50 similar to that in the insulator 27 of the main torch 1.

The positive terminal of the auxiliary torch 39 from the auxiliary power source 42 is connected to the auxiliary mantle 41 through a switching means 44, and the negative terminal of the auxiliary torch 39 from the auxiliary power source 14 is connected to the auxiliary cathode 40 through a switching means 43 and is also connected to the negative terminal of the main power source 7 through the switching means 9 and 46.

Next, a method of plasma spraying the spraying material by using the twin-cathode type plasma spraying apparatus 100*b* is described.

The inert gas such as argon, helium capable of turning into plasma is introduced into the main torch 1 from the main plasma gas introducing port 5 as the main plasma gas 6 to form the swirl flow of the main plasma gas 6. Further, in a state where the switching means 9 is opened and the switching means 8 is closed, a high frequency voltage is applied between the main anode 3 and the main mantle 4 from main power source 7. As a result, the main plasma arc 16 directed from the tip of the main anode 3 toward the opening part 4*a* of the main mantle 4 is formed. This allows the main plasma gas 6 to be heated and become plasma, and then this plasma is released from the opening part 4*a* of the main mantle 4.

Moreover, the inert gas such as argon, helium capable of turning into plasma is introduced as the auxiliary plasma gas 13 from the auxiliary plasma gas introducing port 12 into the auxiliary torch 2 to form the swirl flow of the auxiliary plasma gas 13. Further, a high frequency voltage is applied between the auxiliary cathode 10 and the auxiliary mantle 11 from the auxiliary power source 42 in a state where the switching means 43, 44 are opened and the switching means 45, 46 are closed. As a result, an auxiliary plasma arc 17 directed from the tip 10*a* of the auxiliary cathode 10 toward the hole 11*a* of the auxiliary mantle 24 is formed. This allows the auxiliary plasma gas 13 to be heated and become plasma, and then this plasma is released from the hole 11*a* of the auxiliary mantle 11.

Since the central axis of the main anode 3 and the central axis of the auxiliary cathode 10 are intersected with each other outside the main torch 1 and the auxiliary torch 2 in front of the main anode 3 and the auxiliary cathode 10, when the switching means 45, 46 are opened after the switching means 9 is closed, a conductive path using the hairpin-like plasma 18 that reaches to the anode spot of the main anode 3 from the tip part 10*a* of the auxiliary cathode 10 is formed.

Then, the inert gas such as argon, helium capable of turning into plasma is introduced as an auxiliary plasma gas 49 from an auxiliary plasma gas introducing port 48 into the auxiliary torch to form the swirl flow of the auxiliary plasma gas 49. Further, a high frequency voltage is applied between the auxiliary cathode 40 and the auxiliary mantle 41 from the auxiliary power source 42 in a state where the switching means 43, 44 are closed. As a result, an auxiliary plasma arc 56 directed from a tip 40*a* of the auxiliary cathode 40 toward a hole 41*a* of the auxiliary mantle 41 is formed. This allows the auxiliary plasma gas 49 to be heated and become plasma, and then this plasma is released from the hole 41*a* of the auxiliary mantle 41.

Since the central axis of the main anode 3 and the central axis of the auxiliary cathode 40 are intersected with each other outside the main torch 1 and the auxiliary torch 39 in front of the main anode 3 and the auxiliary cathode 40, the plasma released from the hole 41*a* of the auxiliary mantle 41 intersects with the hairpin-like plasma 18 that reaches the anode spot of the main anode 3 from the tip part 10*a* of the auxiliary cathode 10. In this state, when the switching means 44, 70 are opened after switching means 45, 55 are closed, a conductive path using the T-shaped plasma 18 that reaches to the anode spot of the main anode 3 from the tip parts 10*a*, 40*a* of the auxiliary cathodes 10, 40 is formed, and the plasma flame 23 is formed coaxially with the main torch 1.

The spraying material 20 discharged from the material feed-in pipe 19 through the spraying material discharge hole is supplied to the axial center of the plasma 18 to be formed on the central axis of the main anode 3 by the main anode 3 and the auxiliary cathode 10, and is melted by the plasma flame 23. In one or more embodiments of the present invention, when the spraying material 20 is discharged from the spraying material discharge hole, a gas (for example, the inert gas such as an argon gas, the active gas such as air or an oxygen gas) is introduced by the gas introducing hole 4*c* provided in the tapered part 4*b* of the main mantle 4 to form a swirl gas flow, and this makes it possible to prevent the spraying material 20 from adhering to the opening part 4*a* in the main mantle 4 and on the inner wall of the tip part of the tapered part 4*b*. Further, since the adhesion of the spraying material 20 can be prevented, the spraying material 20 can be efficiently melted. Note that, in the present embodiment, the gas introducing hole 4*c* is provided in the tapered part 4*b* of the main mantle 4. However, the gas introducing hole 4*c* may be provided on the inlet side of the opening part 4*a* of the main mantle 4 or may be provided in the tapered part 4*b* of the main mantle 4 and on the inlet side of the opening part 4*a*, respectively.

Further, as stated above, instead of providing the gas ejection hole 4*c*, the main mantle 4 may be constituted by the porous metallic material M so as to form on the whole inner surface of the mantle the gas flow for preventing the adhesion of the spraying material, and the gas supplied from the gas introducing port 4*d* provided in the main mantle 4 may be ejected only in the inside direction of the main mantle 4 through micropores in the porous metallic material M.

The melt 21 which is the melted spraying material 20 travels toward the base material 25 together with the plasma flame 23. Only plasma 18 is separated immediately in front of the base material 25 by the plasma separation means 22 provided on the connecting pipe 26, the melt 21 is sprayed on the base material 25, and thus, the coating 24 of the dense spraying material 20 having little pores can be efficiently formed.

Note that, in the present embodiment, two auxiliary torches are provided in the plasma spraying apparatus 100*b*. However, three auxiliary torches may be provided. In a case where two or more auxiliary torches are provided, it is preferable that these auxiliary torches are arranged so that their central axes intersect with one another in front of the main anode 3 and at one point of the central axis outside of the main torch 1, and it is more preferable that these auxiliary torches are arranged uniformly on an outer circumference of a circle with the intersecting point as a center and perpendicular to the central axis. Further, in a case where two or more auxiliary torches are provided in the plasma spraying apparatus 100*b*, it is preferable that each of the auxiliary torches is arranged such that the central axis of each of the auxiliary torches perpendicularly intersects with the central axis of the main torch 1 at the above-mentioned intersecting point.

Further, on the tip side of the opening part 4*a* of the main mantle 4 in the above-mentioned plasma spraying apparatuses 100*a*, 100*b*, one or a plurality of electrically-insulated floating electrodes may be provided. Thus, a thermal pinch effect is enhanced and high temperature plasma can be formed, so that it becomes possible to efficiently melt the spraying material 20. Further, a hole through which a gas is introduced may be further provided in a part in which the above-mentioned floating electrodes are arranged to introduce the inert gas (for example, an argon gas or the like) or the active gas (for example, air, oxygen or the like). This prevents the spraying material from adhering to the inter wall of the opening part 4*a* in the upstream side of the floating electrode, while the thermal pinch effect is enhanced and it becomes possible to form higher temperature plasma. Similarly, one or a plurality of electrically-insulated floating electrodes may be provided on the tip side of the opening part (holes 11*a*, 41*a*) of the auxiliary mantles 11, 41. Further, a hole through which a gas is introduced may be further provided in a part in which the floating electrode is arranged to introduce the inert gas (for example, an argon gas or the like) or the active gas (for example, air, oxygen or the like). This enhances a thermal pinch effect, and it becomes possible to form higher temperature plasma.

Figure 3:
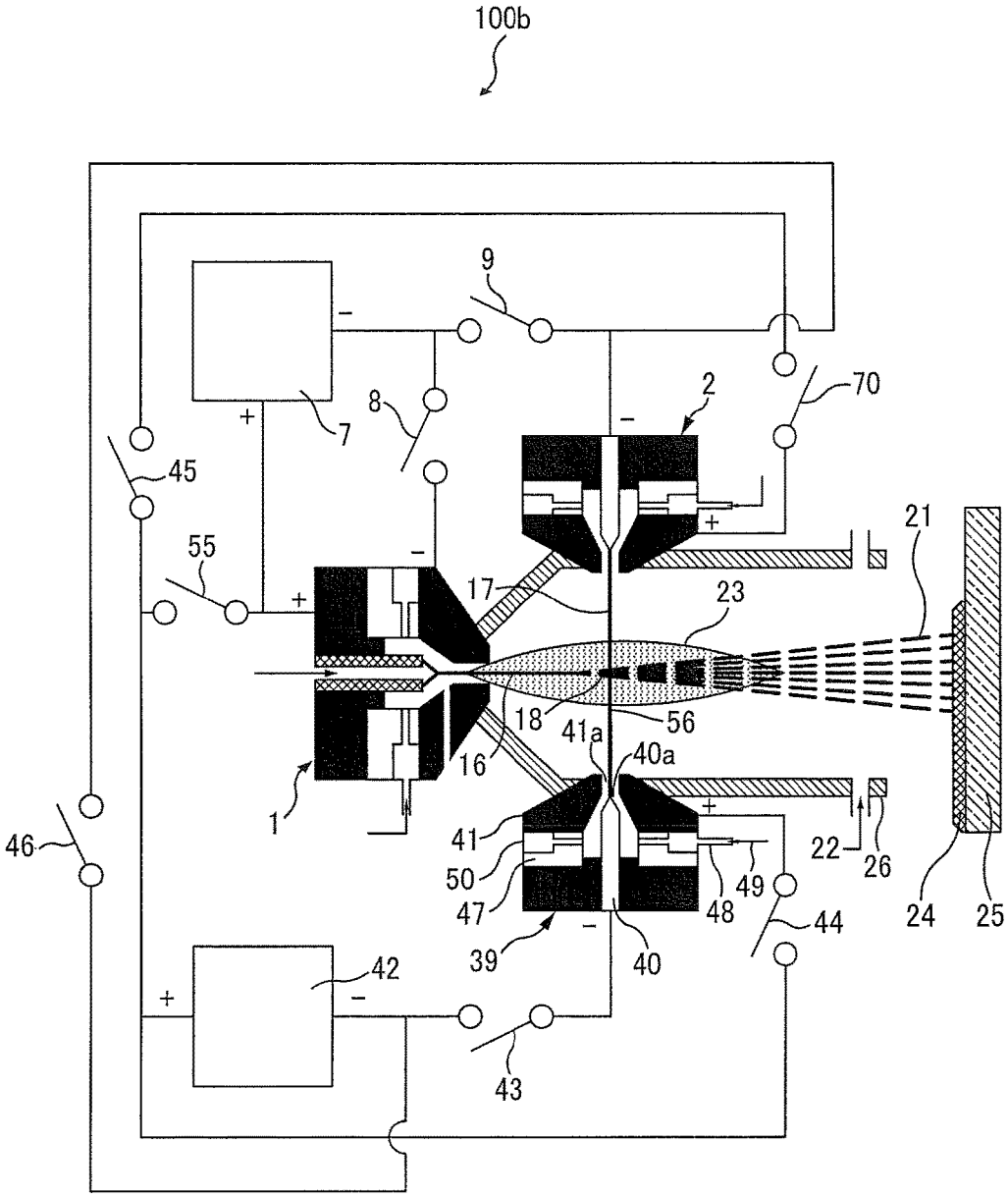
FIG. 3 shows a schematic configuration of a twin-cathode type plasma spraying apparatus 100*b* according to one or more embodiments of the present invention.

Next, as a plasma spraying apparatus in accordance with one or more embodiments of the present invention, an integrated plasma spraying apparatus of a main torch and an auxiliary torch is described in which the auxiliary torch is provided on an outlet side of the opening part in the mantle of the main torch. Note that, in the present embodiment, as an example of the integrated plasma spraying apparatus of the main torch and the auxiliary torch, an integrated plasma spraying apparatus 100*c* is described in which the electrode in the main torch is a main anode and the electrode in the auxiliary torch is an auxiliary cathode. However, the integrated plasma spraying apparatus of the main torch and the auxiliary torch may be an integrated plasma spraying apparatus in which the electrode in the main torch is a main cathode and the electrode in the auxiliary torch is an auxiliary anode. FIG. 3 shows a schematic configuration of the integrated plasma spraying apparatus 100*c* that is illustrated as one or more embodiments of the present invention.

The main torch 1 includes a main anode 3, a main mantle 4 that surrounds the main anode 3, an insulator 27 that insulates the main anode 3 and the main mantle 4 from each other, and the like.

The main anode 3 is formed of a material excellent in electrical conductivity, for example, a metal such as copper. The main anode 3 includes a material feed-in pipe 19 having a spraying material discharge hole at the tip center of the central axis. The main anode 3 is concentrically held with the main mantle 4 by the insulator 27.

The main mantle 4 includes an opening part (nozzle part) 4*a* of the tip part and the tapered part 4*b* provided between the opening part 4*a* and the insulator 27. In the opening part 4*a*, an electrically-insulated insulator 60 is provided. On the downstream side of the opening part 4*a*, an inert gas introducing hole 4*c* that introduces the inert gas to form the swirl gas flow is provided. On the other hand, on the upstream side of the opening part 4*a*, the auxiliary torch 2 is provided.

Further, as with the above-stated embodiment, instead of providing the gas ejection hole 4*c* for forming the swirl flow, the main mantle 4 may be constituted by the porous metallic material M so as to form on the whole inner surface of the mantle the gas flow for preventing the adhesion of the spraying material, and the gas supplied from the gas introducing port 4*d* provided to the main mantle 4 may be ejected only in the inside direction of the main mantle 4 through micropores in the porous metallic material M.

The auxiliary torch 2 includes an auxiliary cathode (auxiliary torch activating electrode) 10, an auxiliary mantle 11 that surrounds the auxiliary cathode 10, an insulator 28 that insulates the auxiliary cathode 10 and the auxiliary mantle 11 from each other, and the like. The central axis of the auxiliary torch 2, that is, the central axis of the auxiliary cathode 10 is arranged so as to intersect with the central axis of the main torch 1, that is, the central axis of the main anode 3 in front of the main anode 3 and the auxiliary cathode 10.

The auxiliary cathode 10 is formed of a material having a high melting point, for example, such as tungsten. The auxiliary cathode 10 is concentrically held with the auxiliary mantle 11 by the insulator 28.

The auxiliary mantle 11 includes a hole at the tip part. The insulator 28 includes an auxiliary plasma gas introducing port 12 that introduces the auxiliary plasma gas 13, and a swirl flow forming means 50 similar to that in the insulator 27 of the main torch 1.

The insulator 27 includes a main plasma gas introducing port 5 that introduces the main plasma gas 6, and a swirl flow forming means 50 of the main plasma gas 6.

The positive terminal of the main power source 7 is connected to the main anode 3, and the negative terminal of the main power source 7 is connected to the tapered part 4*b* of the main mantle 4 through the switching means 8.

The positive terminal of the auxiliary power source 14 is connected to the auxiliary mantle 11, and the negative terminal of the auxiliary power source 14 is connected to the auxiliary cathode 10 through the switching means 15 and is also connected to the negative terminal of the main power source 7 through the switching means 9.

Next, a method of plasma spraying a spraying material by the use of the integrated plasma spraying apparatus 100*c* is described.

The inert gas such as argon, helium capable of turning into plasma is introduced as a main plasma gas 6 from the main plasma gas introducing port 5 into the main torch 1 to form the swirl flow of the main plasma gas 6. Further, a high frequency voltage is applied between the main anode 3 and the tapered part 4*b* of the main mantle 4 from the main power source 7 in a state where the switching means 9 is opened and the switching means 8 is closed. As a result, a main plasma arc that is directed from the tip of the main anode 3 toward the opening part 4*a* of the main mantle 4 is formed, thereby heating the main plasma gas 6.

In addition, the inert gas such as argon, helium capable of turning into plasma is introduced as an auxiliary plasma gas 13 into the auxiliary torch 2 from the auxiliary plasma gas introducing port 12 to form the swirl flow of the auxiliary plasma gas 13. Further, a high frequency voltage is applied between the auxiliary cathode 10 and the auxiliary mantle 11 from the auxiliary power source 14 in a state where the switching means 15 is closed. As a result, the auxiliary plasma arc that is directed from the tip 10*a* of the auxiliary cathode 10 toward the hole 11*a* of the auxiliary mantle 24 is formed, thereby heating the auxiliary plasma gas 13.

Since the central axis of the main anode 3 and the central axis of the auxiliary cathode 10 are intersected with each other in front of the main anode 3 and the auxiliary cathode 10, when the switching means 9 is closed, and the switching means 8, 15 are opened, a conductive path using the hairpin-like plasma that reaches the anode spot of the main anode 3 from the tip part of the auxiliary cathode 10 is formed.

Figure 4:
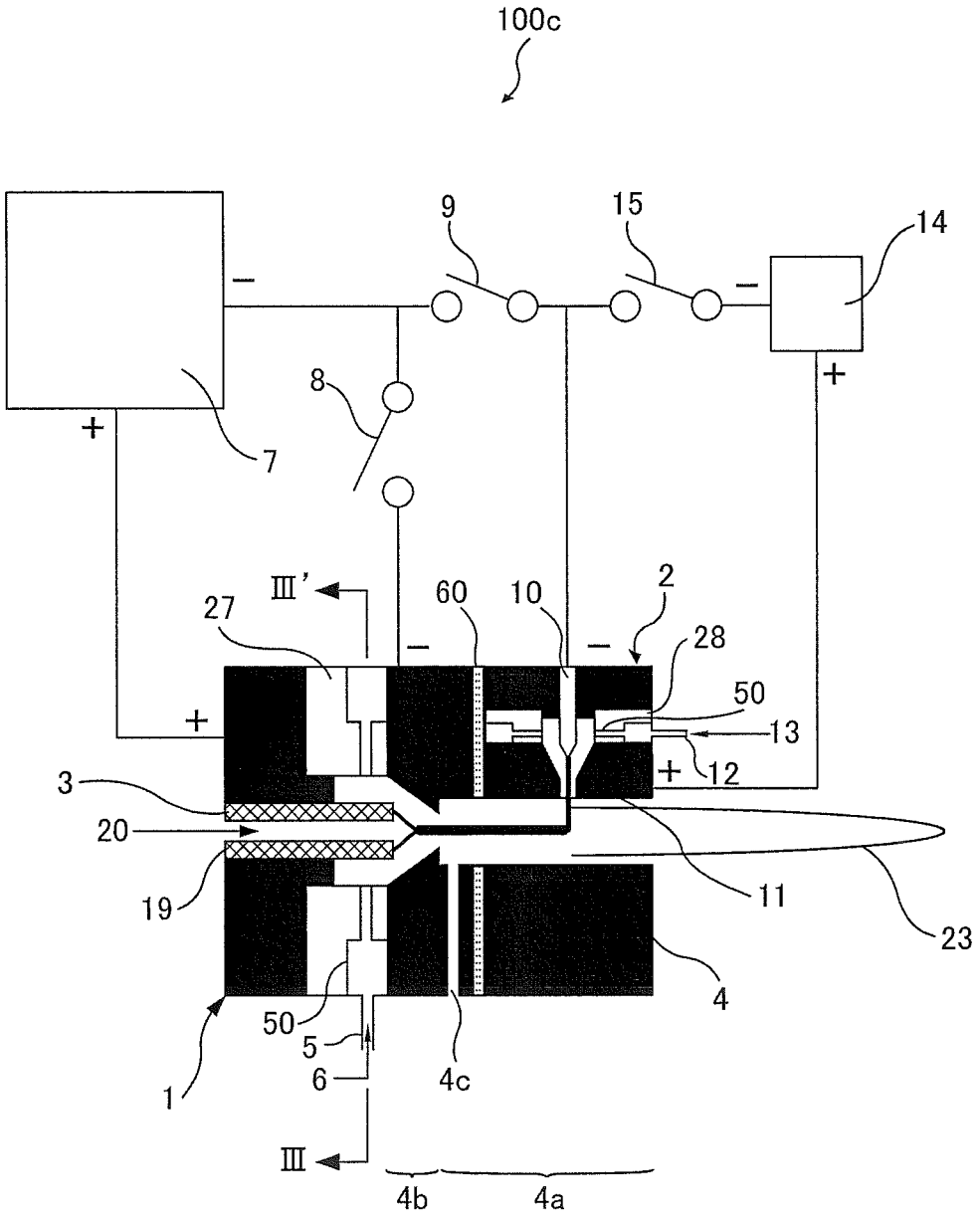
FIG. 4 shows a schematic configuration of an integrated plasma spraying apparatus 100*c* of a main torch and an auxiliary torch according to one or more embodiments of the present invention.

In this case, by appropriately setting the configuration of the main torch 1 and the amount of the main plasma gas 6 to be supplied, and the configuration of the auxiliary torch 2 and the amount of the auxiliary plasma gas 13 to be supplied to the auxiliary torch 2, the plasma flame 23 can be formed substantially coaxially with the main torch 1 as shown in FIG. 4.

The spraying material 20 discharged from the material feed-in pipe 19 through the spraying material discharge hole is supplied to the axial center of plasma to be formed on the central axis of the main anode 3 by the main anode 3 and the auxiliary cathode 10, and is melted by the plasma flame 23. In one or more embodiments of the present invention, the auxiliary torch 2 is embedded in the upstream (tip) of the insulator 60 of the main mantle 4 in the main torch 1, and thus the plasma arc is confined in the main torch 1 to enhance a thermal pinch effect, thereby allowing an input of the plasma arc to be increased. Further, when the spraying material 20 is discharged from the spraying material discharge hole, a gas (for example, the inert gas such as an argon gas, the active gas such as air or an oxygen gas) is introduced by the inert gas introducing hole 4*c* provided on the inlet side of the opening part 4*a* of the main mantle 4 to form the swirl gas flow, and this can prevent the spraying material 20 from adhering to the inner wall of the opening part 4*a* in the main mantle 4. In addition, since the adhesion of the spraying material 20 can be prevented, the spraying material 20 can be efficiently melted. The melt which is the melted spraying material 20 is splayed on the base material 25, and a coating of the dense spraying material 20 having little pores can be efficiently formed. Note that, in the present embodiment, the gas introducing hole 4*c* is provided on the inlet side of the opening part 4*a* of the main mantle 4. However, the gas introducing hole 4*c* may be provided in the tapered part 4*b* of the main mantle 4 and may be provided in the tapered part 4*b* and on the inlet side of the opening part 4*a* in the main mantle 4, respectively.

Further, as state above, instead of providing the gas ejection hole 4*c* for forming the swirl flow, the main mantle 4 may be constituted by porous metallic material M so as to form on the whole inner surface the gas flow for preventing the adhesion of the spraying material, and the gas supplied from the gas introducing port 4*d* provided in the main mantle 4 may be ejected only in the inside direction of the main mantle 4 through micropores in the porous metallic material M.

Figure 6:
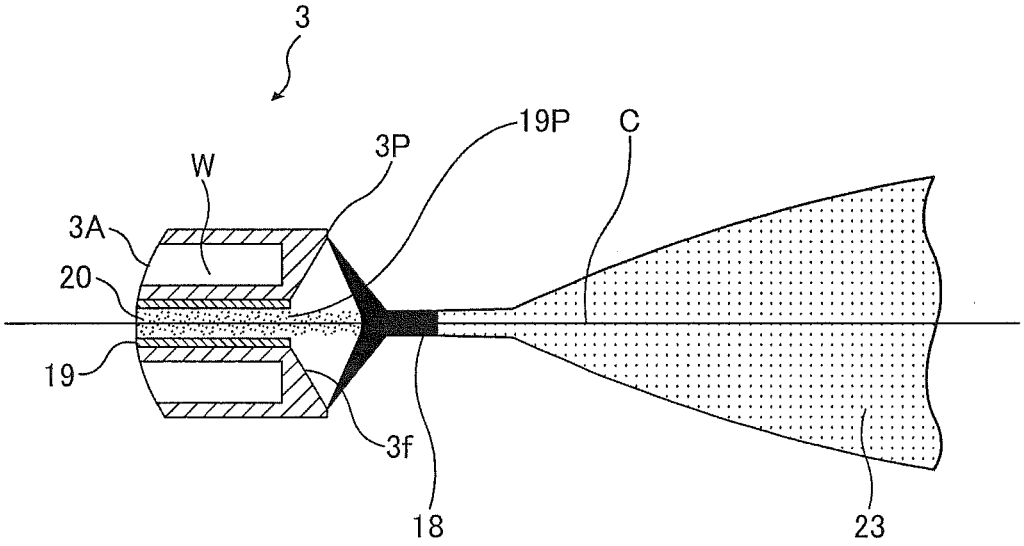
FIG. 6 shows a schematic configuration of the tip part of the main anode according to one or more embodiments of the present invention.
Figure 7:
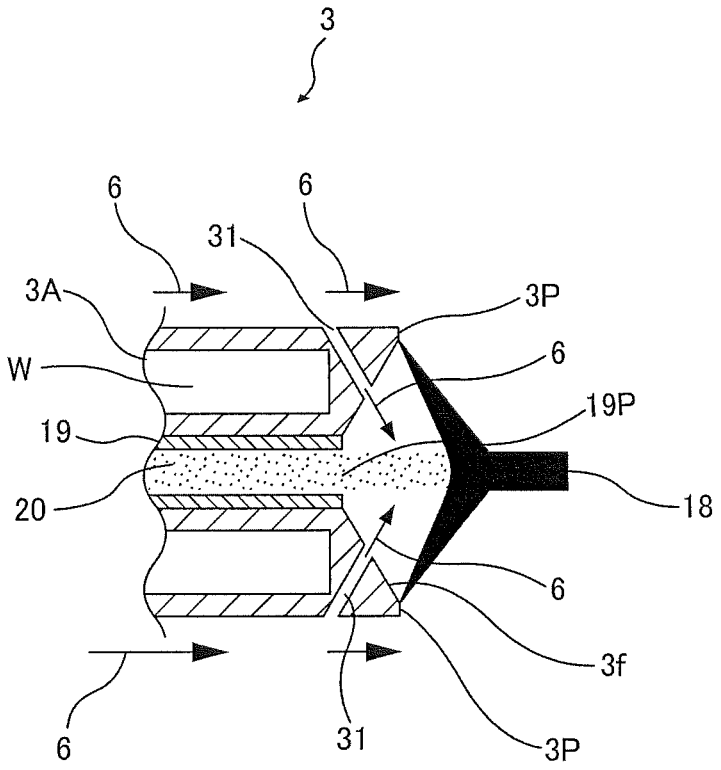
FIG. 7 shows a schematic configuration of the tip part of the main anode according to one or more embodiments of the present invention.
Figure 8:
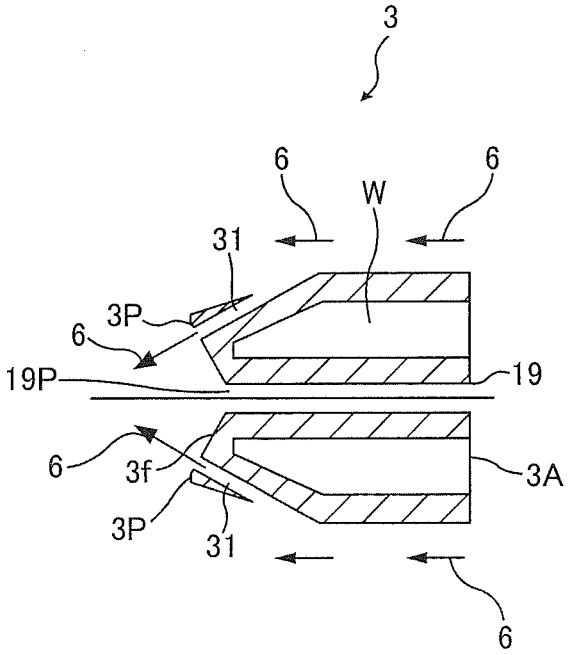
FIG. 8 shows a schematic configuration of the tip part of the main anode according to one or more embodiments of the present invention.

Next, one or more embodiments of the main anode 3 in the above-mentioned plasma spraying apparatuses 100*a* to 100*c* are exemplified. FIGS. 6 to 8 show schematic configurations of the tip part of the main anode 3 according to one or more embodiments of the present invention.

As shown in FIG. 6, the main anode 3 is provided with a cooling passage 3A that circulates cooling water W, between the outer peripheral surface of the main anode 3 and the material feed-in pipe 19.

A tip surface 3*f* of the main anode 3 is formed in an inwardly protruding shape on the central axis (for example, an inwardly protruding truncated cone shape or the like). A spraying material discharge hole 19P that is an outlet of the material feed-in pipe 19 is arranged at the center of the tip surface 3*f* of the main anode 3, and a protruding part (edge of the tip) of the outer periphery of the tip of the main anode 3 is an anode spot 3P.

In the spraying material 20 fed from the material feed-in pipe 19, as shown in FIG. 6, the position of the anode spot 3P of the main anode 3 is provided to be closer to the cathode spot than the position of the spraying material discharge hole 19P of the material feed-in pipe 19, so that when the spraying material 20 is supplied, the spraying material 20 and the anode spot of the plasma (plasma arc) 18 do not interfere with each other. Further, since the axial center of the plasma 18 is placed on the same straight line as the central axis C of the main torch 1, the spraying material 20 can be supplied to a high temperature part of the plasma 18 and can be substantially completely melted. As the spraying material 20 to be supplied, powders of a conductive material such as metal, an insulating material such as ceramics, or the like can be used. Note that, when the conductive material such as metal is used, it is preferable that the material feed-in pipe 19 is produced by a material such as ceramics having heat resistance and insulating properties.

Note that, the configuration of the tip part of the main anode 3 is not particularly limited as long as the anode spot 3P is located on the outer circumferential side of the spraying material discharge hole 19P and is arranged so as not to allow the anode spot 3P and the spraying material discharge hole 19P to interfere with each other. Further, as shown in FIG. 7, the tip part of the main anode 3 preferably includes one or a plurality of gas ejection holes 31 for preventing the adhesion of the spraying material, which penetrates from the outer peripheral face at a position where the spraying material discharge hole 19P and the anode spot 3P do not interfere with each other, for example, at a position between the spraying material discharge hole 19P and the anode spot 3P on the tip surface 3*f*. Further, it is more preferable that the tip part of the main anode 3 is formed in a truncated cone shape as shown in FIG. 8, and the above-mentioned gas ejection hole 31 is provided so as to penetrate from the outer peripheral face at the position where the spraying material discharge hole 19P and the anode spot 3P on the tip surface 3*f* do not interfere with each other.

REFERENCE SIGNS LIST

1: main torch, 2: auxiliary torch, 3: main anode, 3A: cooling passage, 3*f*: tip surface, 3P: anode spot, 4: main mantle, 4*a*: opening part, 4*b*: tapered part, 4*c*: gas introducing hole, 4*d*: gas introducing port, 5: main plasma gas introducing port, 6: main plasma gas, 7: main power source, 8, 9: switching means, 10: auxiliary cathode, 10*a*: tip of the auxiliary cathode, 11: auxiliary mantle, 11*a*: hole, 12: auxiliary plasma gas introducing port, 13: auxiliary plasma gas, 14: auxiliary power source, 15: switching means, 16: main plasma arc, 17: auxiliary plasma arc, 18: plasma, 19: material feed-in pipe, 19P: spraying material discharge hole, 20: spraying material, 21: melt, 22: plasma separation means, 23: plasma flame, 24: coating, 25: base material, 26: connecting pipe, 27, 28: insulator, 31: gas ejection hole, 39: auxiliary torch, 40: auxiliary cathode, 40*a*: tip of auxiliary cathode, 41: auxiliary mantle, 41*a*: hole, 42: auxiliary power source, 43, 44, 45 and 46: switching means, 47: insulator, 48: auxiliary plasma gas introducing port, 49: auxiliary plasma gas, 50: swirl flow forming means, 51: gas annular chamber, 52: swirl flow forming hole, 53: inner wall, 55: switching means, 56: auxiliary plasma arc, 60: insulator, 70: switching means, 100*a*: combined torch type plasma spraying apparatus, 100*b*: twin-cathode type plasma spraying apparatus, 100*c*: integrated plasma spraying apparatus, C: central axis, M: porous metallic body, W: cooling water Although this disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A plasma spraying apparatus, comprising:

a main torch comprising:

a first electrode comprising a spraying material discharge hole at a tip center of a central axis;

a first mantle that surrounds the first electrode; and a first insulator that insulates the first electrode and the first mantle from each other and comprises a first plasma gas introducing port; and an auxiliary torch comprising:

a second electrode;

a second mantle that surrounds the second electrode; and a second insulator that insulates the second electrode and the second mantle from each other and has a second plasma gas introducing port, the auxiliary torch having a central axis that intersects with a central axis of the main torch; and a connecting pipe that connects the main torch and the auxiliary torch, wherein the spraying material discharge hole supplies a spraying material to an axial center of plasma that is formed on the central axis of the first electrode by the first electrode and the second electrode, the spraying material is melted and sprayed on a base material to form a coating, the first mantle comprises an opening part and a tapered part provided between the opening part and the first insulator, the first mantle comprises, on an inlet side of the opening part and/or or the tapered part, a gas introducing part that introduces gas, the gas introducing part introduces gas within the tapered part of the first mantle, and the gas introducing part is formed on a material of the first mantle that is different from a material of the first insulator.

2. The plasma spraying apparatus according to claim 1, wherein the first electrode is an anode, and the second electrode is a cathode.

3. The plasma spraying apparatus according to claim 2, wherein the opening part comprises a third insulator at the center, and the auxiliary torch is provided closer to an outlet side than the third insulator of the opening part.

4. The plasma spraying apparatus according to claim 2, wherein the main torch and the auxiliary torch are arranged so that a plasma arc is formed on the outside.

5. The plasma spraying apparatus according to claim 4, further comprising a plurality of auxiliary torches, wherein the plurality of auxiliary torches are arranged so that central axes of the plurality of auxiliary torches intersect at one point of the central axis of the main torch outside the main torch.

6. The plasma spraying apparatus according to claim 3, wherein an anode spot of the first electrode and the spraying material discharge hole do not to interfere with one another.

7. The plasma spraying apparatus according to claim 3, wherein a tip surface of the first electrode is formed in an inwardly protruding shape on the central axis.

8. The plasma spraying apparatus according to claim 3, wherein a tip of the first electrode is provided with a gas ejection hole that prevents adhesion of the spraying material.

9. The plasma spraying apparatus according to claim 1, wherein the gas introducing part of the first mantle comprises, on an inlet side of the opening part and/or the tapered part, a gas ejection hole that introduces gas.

10. The plasma spraying apparatus according to claim 1, wherein the gas introducing part of the first mantle comprises a gas ejection hole through which gas is ejected to have a circumferential velocity component with respect to the central axis so that the gas is allowed to be a swirl flow inside the opening part and the tapered part.

11. The plasma spraying apparatus according to claim 1, wherein the first mantle is a porous metal, and the gas introducing part ejects gas introduced from the outside through holes in the porous metal only in an inside direction of the first mantle.

12. The plasma spraying apparatus according to claim 4, wherein an anode spot of the first electrode and the spraying material discharge hole do not to interfere with one another.

13. The plasma spraying apparatus according to claim 5, wherein an anode spot of the first electrode and the spraying material discharge hole do not to interfere with one another.

14. The plasma spraying apparatus according to claim 4, wherein a tip surface of the first electrode is formed in an inwardly protruding shape on the central axis.

15. The plasma spraying apparatus according to claim 5, wherein a tip surface of the first electrode is formed in an inwardly protruding shape on the central axis.

16. The plasma spraying apparatus according to claim 4, wherein a tip of the first electrode is provided with a gas ejection hole that prevents adhesion of the spraying material.

17. The plasma spraying apparatus according to claim 5, wherein a tip of the first electrode is provided with a gas ejection hole that prevents adhesion of the spraying material.

18. The plasma spraying apparatus according to claim 2, wherein the gas introducing part of the first mantle comprises a gas ejection hole through which gas is ejected to have a circumferential velocity component with respect to the central axis so that the gas is allowed to be a swirl flow inside the opening part and the tapered part.

19. The plasma spraying apparatus according to claim 3, wherein the gas introducing part of the first mantle comprises a gas ejection hole through which gas is ejected to have a circumferential velocity component with respect to the central axis so that the gas is allowed to be a swirl flow inside the opening part and the tapered part.

20. The plasma spraying apparatus according to claim 4, wherein the gas introducing part of the first mantle comprises a gas ejection hole through which gas is ejected to have a circumferential velocity component with respect to the central axis so that the gas is allowed to be a swirl flow inside the opening part and the tapered part.

* * * * *